US006449941B1

(12) United States Patent
Warboys et al.

(10) Patent No.: US 6,449,941 B1
(45) Date of Patent: Sep. 17, 2002

(54) HALL EFFECT ELECTRIC PROPULSION SYSTEM

(75) Inventors: Leslie R. Warboys, Littleton, CO (US); James A. Lukash, Highlands Ranch, CO (US); Diana K. Mann, Arvada, CO (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 09/560,439

(22) Filed: Apr. 28, 2000

Related U.S. Application Data

(60) Provisional application No. 60/131,458, filed on Apr. 28, 1999, and provisional application No. 60/131,457, filed on Apr. 28, 1999.

(51) Int. Cl.[7] ..... F30H 3/00; H05H 1/00

(52) U.S. Cl. ..... 60/202

(58) Field of Search ..... 60/202, 203.1; 313/354–363; 315/111.01, 5.41, 5.42

(56) References Cited

U.S. PATENT DOCUMENTS

| | | | | | |
|---|---|---|---|---|---|
| 4,318,028 | A | | 3/1982 | Perel et al. | 315/111.81 |
| 4,577,461 | A | * | 3/1986 | Cann | 60/203.1 |
| 4,838,021 | A | * | 6/1989 | Beattie | 60/202 |
| 4,862,032 | A | * | 8/1989 | Kaufman et al. | 313/359 |
| 5,097,179 | A | | 3/1992 | Takayama | 315/111.81 |
| 5,646,476 | A | * | 7/1997 | Aston | 313/359 |
| 5,845,880 | A | * | 12/1998 | Petrosov et al. | 244/169 |
| 5,947,421 | A | * | 9/1999 | Beattie et al. | 244/172 |
| 6,121,569 | A | * | 9/2000 | Miley et al. | 219/121.48 |
| 6,150,764 | A | * | 11/2000 | Hruby et al. | 315/111.61 |
| 6,195,980 | B1 | * | 3/2001 | Walther | 60/202 |

OTHER PUBLICATIONS http://aml.arizona.edu/classes/mse222/1998/teflon/properties.htm.*

Overview of Electric Propulsion Devices and Power Systems. [online] [retrieved on Feb. 29, 2000] [retrieved from http://trajectory.grc.nasa.gov].

* cited by examiner

*Primary Examiner*—Charles G. Freay
*Assistant Examiner*—William H. Rodriguez
(74) *Attorney, Agent, or Firm*—Swidler Berlin Shereff Friedman, LLP

(57) ABSTRACT

A Hall effect electric propulsion system having an electromagnet with an internal acceleration chamber and an internal ionizer is disclosed. An aperture formed in one end of the electromagnet opens into the acceleration chamber. The magnetic poles of the electromagnet are positioned non-parallel in relation to each other on opposite sides of the aperture. The ionizer located within the acceleration chamber ionizes a flow of propellant molecules introduced into the acceleration chamber. An electron generator external to the electromagnet directs an electron beam towards an asymmetric magnetic field generated by the electromagnet about the throat. Electrons are trapped in a flux of the magnetic field to form an electron cloud, which functions as a phantom cathode. The positively ionized flow of propellant molecules are electromagnetically accelerated toward and pass through the electron cloud and are neutralized by combining with electrons trapped in the electron cloud, producing neutral propellant molecules having momentum that provide thrust.

21 Claims, 4 Drawing Sheets

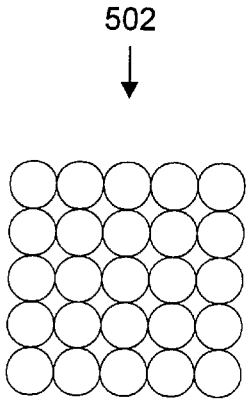
FIG. 5A
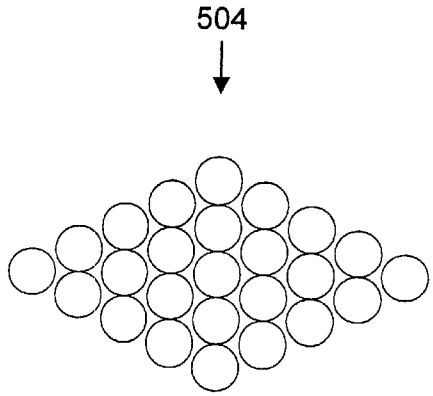
FIG. 5B
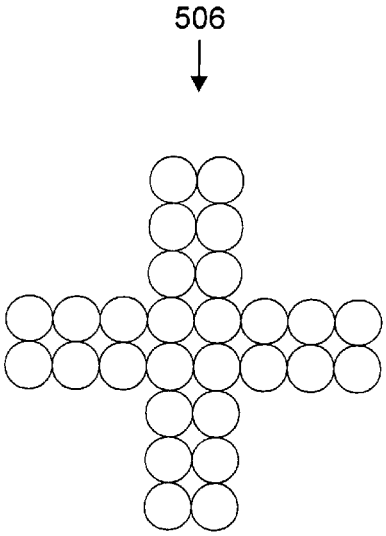
FIG. 5C
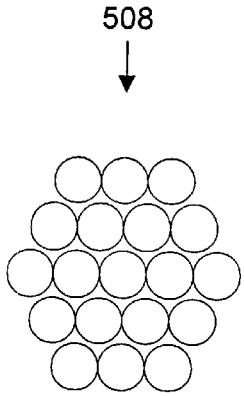
FIG. 5D
FIG. 5

HALL EFFECT ELECTRIC PROPULSION SYSTEM

RELATED APPLICATIONS

This application claims the benefit of U.S. Provisional Applications Nos. 60/131,458 and 60/131,457, both filed on Apr. 28, 1999, the entire disclosures of which are incorporated by reference herein.

FIELD OF THE INVENTION

This invention relates to electric propulsion systems, and more particularly, to an improved Hall effect electric propulsion system.

BACKGROUND OF THE INVENTION

Hall effect electric propulsion systems, also referred to as Hall current thrusters and ion rocket engines, have been utilized for many years on various types of spacecraft, including commercial satellites, military satellites, and space probe applications. Once in space, the Hall current thrusters provide the propulsion necessary for orbital maneuvering and directional changes. Conventional Hall current thrusters utilize external hollow cathodes to produce an arc that ionizes a noble gas propellant within an acceleration chamber. This present technique results in long arc lengths stretching from the external hollow cathode to inside the acceleration chamber, and results in an inefficient transfer of energy to the gaseous propellant introduced into the acceleration chamber. In addition, the high electromagnetic interference (EMI) from such Hall current thrusters may interfere with the operations of the spacecraft, especially communications satellites. In this regard, ability of a communications satellite to send and receive signals may be inhibited when existing Hall current thrusters are firing.

SUMMARY OF THE INVENTION

Accordingly, it is an object of the present invention to provide a Hall effect electric propulsion system.

Yet another object of the invention is to provide a Hall effect electric propulsion system that is more energy efficient than current Hall effect electric propulsion systems.

Still another object of the invention is to provide a Hall effect electric propulsion system that results in reduced electromagnetic interference.

Another object of the invention is to provide a Hall effect electric propulsion system which minimizes erosion damage to external surfaces of the spacecraft caused by non-neutralized ions expelled from the thruster.

Another object of the invention is to provide a Hall effect electric propulsion system which minimizes erosion damage to external surfaces of the spacecraft caused by non-recombined electrons emitted from an electron generator.

The present invention achieves one or more of these objectives by providing an improved Hall effect electric propulsion system. Generally, in one aspect of the present invention, the Hall effect electric propulsion system includes a magnet (e.g., an electromagnet, permanent magnet) having an internal acceleration chamber. An aperture, or throat, formed in one end of the magnet opens into the acceleration chamber. The magnetic poles of the magnet are positioned relative to each other on opposite sides of the aperture. An ionizer located within the acceleration chamber ionizes a flow of propellant molecules introduced into the acceleration chamber. An electron generator or gun external to the magnet directs an electron beam towards a magnetic field generated by the magnet about the throat. A portion of the electrons of the electron beam become trapped in a flux of the magnetic field to form an electron cloud, which functions as a phantom cathode. A positively ionized flow of propellant molecules are accelerated (e.g., electrostatically or electromagnetically) toward and pass through the electron cloud. A large portion (e.g., greater than half) of the ionized flow of propellant molecules passing through the electron cloud become neutralized by combining with a portion of the electrons trapped within the electron cloud, producing a plurality of neutral propellant molecules having momentum to produce thrust. Of importance, locating the ionizer within the acceleration chamber reduces the size of the arc needed for ionization purposes, which in turn requires less energy and increases efficiency relative to existing Hall effect propulsion systems.

In another aspect of the invention, the Hall effect electric propulsion system includes an electromagnet having an internal acceleration chamber and an aperture formed in one end of the chamber. The magnetic poles of the electromagnet are positioned relative to each other on opposite sides of the aperture, and the opposing faces of each pole are angled outward so as to be non-parallel to each other. This produces an asymmetric magnetic field which aids in trapping electrons in the field's fringe region. An electron gun located exterior to the acceleration chamber generates an electron beam toward the asymmetric magnetic field where some of the electrons are trapped. Other electrons not trapped would impact a sacrificial anode. The positively ionized flow of propellant molecules are accelerated towards and pass through the electron cloud. A large portion of the ionized flow of propellant molecules passing through the electron cloud become neutralized by combining with a portion of electrons trapped within the electron cloud. This produces a plurality of neutral propellant molecules having momentum to provide thrust which enhances efficiency.

In one embodiment, the internal surfaces of the acceleration chamber are coated with TEFLON®. TEFLON® has the property of holding a charge. When ionized propellant molecules brush up against the TEFLON® coated internal surface area of the acceleration chamber, the TEFLON® builds up a positive charge. Beyond a certain amount of initial loss, the ionized propellant molecules can brush against the internal surfaces without losing their charge, thus improving the efficiency of the Hall effect electric propulsion system. In addition, once the positive charge is built up on the TEFLON® coated internal surfaces of the acceleration chamber, the positively charged ions are repelled by the positive charge, resulting in minimal collision and erosion by the ionized particles within the acceleration chamber itself which enhances the efficiency of the system.

In another embodiment, the acceleration chamber is divided up into segments, with each segment having its own ionizer, propellant gas supply tube, and control valve. Vectorable thrust is achieved through throttling various combinations of chamber segments.

In another embodiment, a number of individual Hall effect electric propulsion systems are arranged in a pattern forming an array. The array is then attached to a side of a spacecraft. More than one array may be attached to the spacecraft. Vectorable thrust is achieved through activating various combinations of the individual Hall effect electric propulsion systems in the array.

DESCRIPTION OF THE DRAWINGS

FIG. 5 shows several different array patterns of Hall effect electric propulsion systems of the present invention for attaching to a side of a spacecraft.

DETAILED DESCRIPTION

Figure 1:
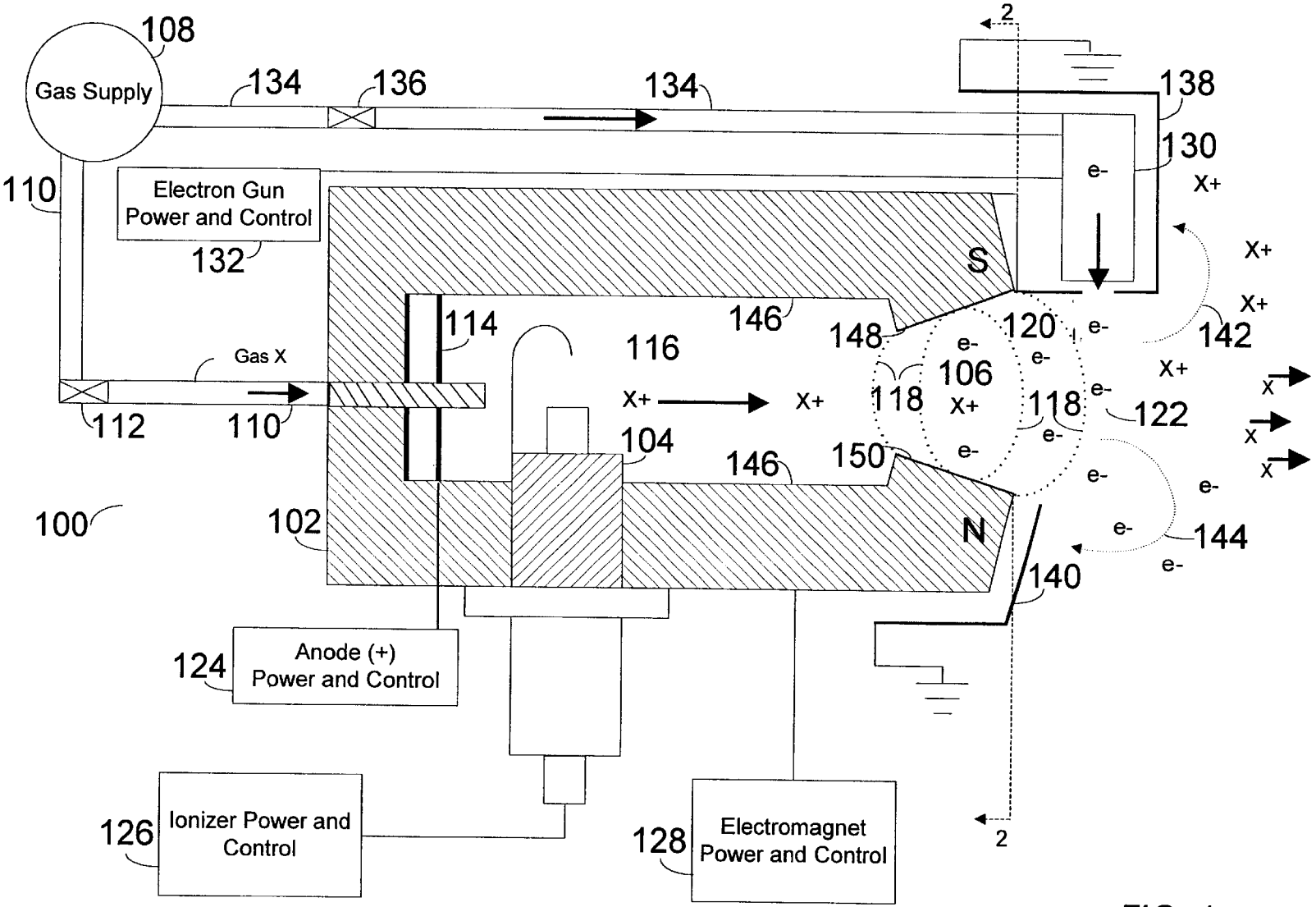
FIG. 1 shows a schematic/block diagram, partially cut away view, of the Hall effect electric propulsion system of the present invention.

FIG. 1 shows a schematic/block diagram, partially cut away view, of the Hall effect electric propulsion system of the present invention. Referring now to FIG. 1, Hall effect electric propulsion system 100 has electromagnet 102 with aperture 106 (see also FIG. 2) at one end, positive anode 114 at the other end, and acceleration chamber 116 defined therebetween. Propellant molecules are introduceable within acceleration chamber 116 through supply tube 110 which is connected to a gas supply 108 which is under pressure. Control valve 112 regulates the flow of propellant molecules into acceleration chamber 116. The propellant molecules are typically gas molecules. Any of the noble gases such as xenon, hydrogen or helium are very suitable. In a preferred embodiment, Xenon is used because of its high molecular weight.

Located within acceleration chamber 116 is ionizer 104. Ionizer 104 may be any type of ionization source, such as an electric arc or a spark plug. As the propellant molecules are introduced into acceleration chamber 116, ionizer 104 positively ionizes them. Ionizer power and control 126 controls the power level for the ionization process. Anode power and control 124 controls the power level supplied to positive anode 114.

Figure 2:
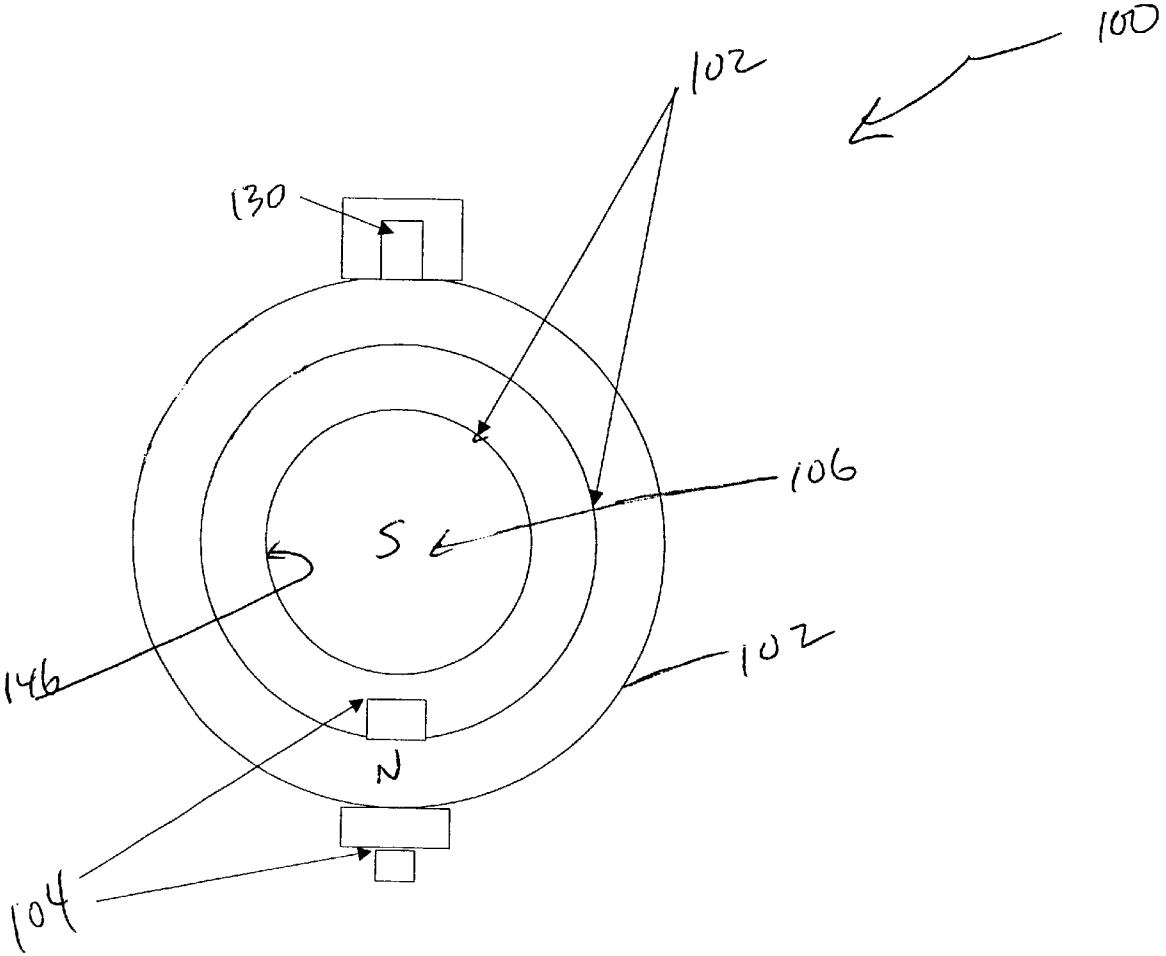
FIG. 2 shows an end view, partially cut away, of the Hall effect electric propulsion system of FIG. 1 of the present invention.

Positive anode 114 repels the positively charged ions toward aperture 106. Aperture 106, best shown in FIG. 2, is circular, but may also be of other shapes, including square, rectangular, and elliptical. In addition, the interior surfaces 146 (see also FIG. 2) of acceleration chamber 116 are coated with TEFLON®, which builds up and holds a positive charge as ionized propellant molecules brush up against interior surfaces 146. Beyond a certain amount of initial loss, the ionized propellant molecules can brush against internal surfaces 146 without losing their charge. The positive charge built up on the TEFLON® coated internal surfaces 146 of acceleration chamber 116 help to repel the positively charged ions away from the internal surfaces 146, resulting in minimal collision and erosion by the ionized particles within acceleration chamber 116.

Electromagnet power and control 128 controls the power level supplied to the electromagnet, which can tune the magnetic field to increase the efficiency of the system and to adjust the density of the electron cloud at the aperture. The magnetic field induced between the south pole face 148 and the north pole face 150 of electromagnet 102 create a flux 118 about aperture 106. Electron gun 130 directs a beam of electrons toward flux 118 of the magnetic field. Electrons are trapped in the lines of force of flux 118 forming an electron cloud 120. Electron cloud 120 at aperture 106 functions as a phantom cathode 122. The positively ionized flow of propellant molecules within acceleration chamber 116 are accelerated towards electron cloud 120. In an alterative embodiment, for purposes of conserving power, a permanent magnet can be utilized instead of an electromagnet. The Hall effect electric propulsion system 100 of the present invention uses electron gun 130 as an ionization source.

South pole face 148 and north pole face 150 of electromagnet 102 are oriented non-parallel relative to each other, which causes flux 118 of the magnetic field induced between the poles to be asymmetric. This non-parallel configuration enables the magnetic field to have a greater gradient, resulting in a very strong phantom cathode 122 where the electrons trapped in flux 118 are more concentrated toward the center of aperture 106.

Also, for the purpose of reducing noise, due to the placement of ionizer 104 within acceleration chamber 116, ionization takes place more centrally within acceleration chamber 116 rather than closer to the throat. Hall effect electric propulsion system 100 of the present invention contains the arc internally within acceleration chamber 116 resulting in an arc length that is much shorter. Though typical Hall effect thrusters are able to ionize the propellant gas molecules and generate the electron cloud necessary to accelerate the gas further with one system, they are very wasteful of energy and extremely noisy electromagnetically. Hall effect electric propulsion system 100 ionizes the propellant gas molecules in a much quieter fashion and at the same time improves the electron cloud that provides the acceleration. In addition, aperture 106 serves as a waveguide beyond cutoff. Frequencies below that of the frequency of aperture 106 will not escape the acceleration chamber through aperture 106. Thus, the EMI frequencies of Hall effect electric propulsion system 100 can be controlled through aperture 106 and ionizer 104 so as not to interfere with the signals being sent and received by a communications satellite that utilizes Hall effect electric propulsion system 100.

Electron gun power and control 132 controls the power level supplied to electron gun 130. Electron gun 130 is a gas-fed electron gun, though non-gas-fed electron guns may also be used. Gas molecules from gas supply 108 are introduceable into electron gun 130 through supply tube 134. Control valve 136 controls the flow of gas molecules to electron gun 130. Electron gun 130 emits a beam of electrons towards flux 118 produced by electromagnet 102. As the electrons hit the lines of force of flux 118, the Hall effect induces a gyroscopic action and causes the electrons to orbit the lines of flux. The straight line motion of the electrons is converted into a spinning motion about the lines of force of flux 118, essentially trapping the electrons in flux 118 and forming electron cloud 120. Collisions between electrons on the same line of force of flux 118 will step electrons to the next inner flux line, increasing the concentration of electrons along the inner flux lines. The gradient is set for the lines of force of flux 118 such that the electrons are prevented from moving inside acceleration chamber 116. Phantom cathode 122 formed by electron cloud 120 thus attracts the positively ionized gas molecules from acceleration chamber 116, providing the acceleration of the ionized propellent gas molecules that produces thrust.

As the ionized flow of propellant molecules pass through electron cloud 120, a large portion of the ionized propellant molecules are neutralized by absorbing a portion of the electrons trapped in electron cloud 120. Once neutralized, the propellant molecules provide a neutral mass flow generating thrust. Thrust comes from the fact that positively charged ions are being attracted very strongly to phantom cathode 122. When they pass through electron cloud 120 and recombine and become neutral, the magnetic field has no effect anymore. The charged particles and electrons have no effect on the neutralized molecules, and the neutralized molecules keep their acceleration and continue their motion outward from acceleration chamber 116, providing the neutral mass which produces the momentum thrust.

The amount of thrust generated by Hall effect electric propulsion system 100 can be controlled, or tuned, by any or a combination of the following: adjusting the flow of the propellant gas into acceleration chamber 116; adjusting the flow of the gas that goes to electron gun 130; adjusting the output of electron gun 130 with electron gun power and control 132; adjusting the power delivered to electromagnet 102 with electromagnet power and control 128; adjusting the power delivered to ionizer 104 with ionizer power and control 126; and adjusting the power delivered to anode 114 with anode power and control 124.

A small (e.g., less than half) portion of the ionized propellant molecules that pass through electron cloud 120 are not neutralized and remain positively charged. These non-neutralized ions are attracted back towards the spacecraft. This has caused serious erosion problems in conventional Hall effect thrusters due to the sandblasting effect these ions have when they strike the spacecraft. The Hall effect electric propulsion system 100 of the present invention is designed so that it is at the same ground potential as the rest of the spacecraft. The non-neutralized ions are attracted to ion sacrificial anode housing 138 generally along ion path 142. Ion sacrificial anode housing 138 is made of a suitable metal, such as aluminum, that is thick enough to accommodate all the erosion that is anticipated. Thus all of the erosion occurs on a surface that will not result in harm to the spacecraft.

Figure 3:
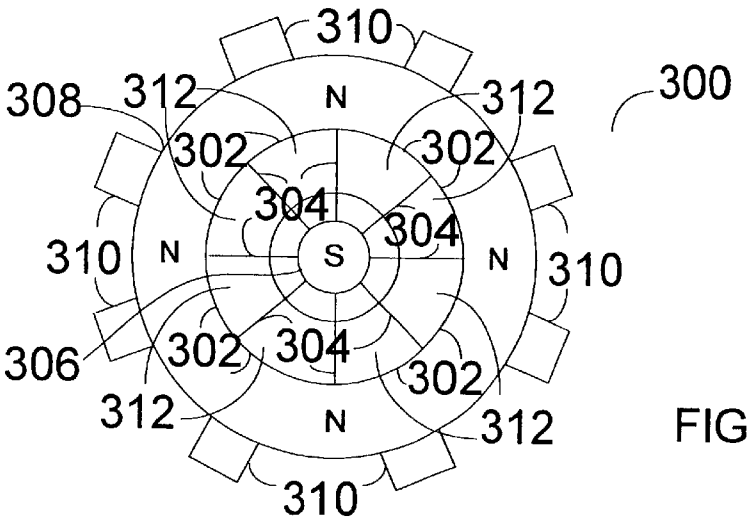
FIG. 3 shows a schematic diagram of the Hall effect electric propulsion system of the present invention that has an annularly segmented acceleration chamber.

FIG. 3 shows a schematic diagram of the Hall effect electric propulsion system of the present invention that has an annularly segmented acceleration chamber. Referring now to FIG. 3, Hall effect electric propulsion system 300 has an acceleration chamber that is segmented by dividers 304 forming acceleration chamber segments 302. Each acceleration chamber segment 302 opens up into aperture 312. Dividers 304 are made of any suitable insulated nonferromagnetic material.

Each acceleration chamber segment 302 has a corresponding ionizer 310, a supply tube (not shown in FIG. 3), and a control valve (also not shown in FIG. 3). An electromagnet having south pole 306 and north pole 308 serves all acceleration chamber segments 302.

Traditionally, thrusters have used gimbals or other thrust deflection mechanisms to direct exhaust products to enable steering of a spacecraft. Acceleration chamber segments 302 provide steering capability to Hall effect electric propulsion system 300 by throttling different combinations of the acceleration chamber segments 302. Different thrust vectors can be achieved by turning on or off various combinations of acceleration chamber segments 302.

The output of each acceleration chamber segment 302 may be throttled by controlling the propellant flow to each acceleration chamber segment 302 and controlling the ionization energy for each ionizer 310. In the event of an individual failure of one acceleration chamber segment 302, the entire Hall effect electric propulsion system 300 would not be lost, since the remaining operational segments may be selectively throttled to compensate for the failed acceleration chamber segment 302. More than one individual acceleration chamber segments 302 could fail and be compensated for by the remaining acceleration chamber segments 302 depending upon which segments fail. This gives both a steering mechanism without gimbals, a significant weight savings, and engine redundancy in a single unit at significant savings in complexity and cost. This also allows for optimized trajectories where turning and thrusting maneuvers may be combined to save fuel.

Figure 4:
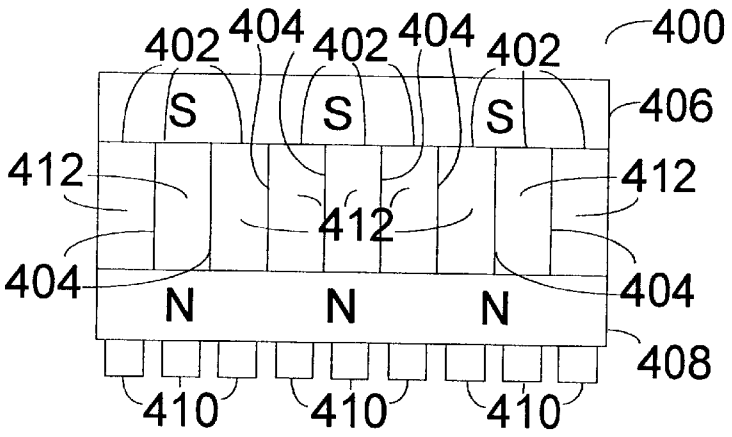
FIG. 4 shows a schematic diagram of the Hall effect electric propulsion system of the present invention that has a linearly segmented acceleration chamber.

FIG. 4 shows a schematic diagram of the Hall effect electric propulsion system of the present invention that has a linearly segmented acceleration chamber. Referring to FIG. 4, Hall effect electric propulsion system 400 has an acceleration chamber that is segmented by dividers 404 forming acceleration chamber segments 402. Each acceleration chamber segment 402 opens up into aperture 412. Dividers 404 are made of any suitable insulated nonferromagnetic material. One skilled in the art will recognize that acceleration chamber 116 of Hall effect electric propulsion system 100 (FIG. 1) could also be segmented through use of dividers 404.

Each acceleration chamber segment 402 has a corresponding ionizer 410, a supply tube (not shown in FIG. 4), and a control valve (also not shown in FIG. 4). An electromagnet having south pole 406 and north pole 408 serves all acceleration chamber segments 402.

Acceleration chamber segments 402 provide steering capability to Hall effect electric propulsion system 400 by throttling different combinations of the acceleration chamber segments 402. Different thrust vectors can be achieved by turning on or off various combinations of acceleration chamber segments 402. The output of each acceleration chamber segment 402 may be throttled by controlling the propellant flow to each acceleration chamber segment 402 and controlling the ionization energy for each ionizer 410. In the event of an individual failure of one acceleration chamber segment 402, the entire Hall effect electric propulsion system 400 would not be lost, since the remaining operational segments may be selectively throttled to compensate. This gives both a steering mechanism without gimbals, a significant weight savings, and engine redundancy in a single unit at significant savings in complexity and cost. This also allows for optimized trajectories where turning and thrusting maneuvers may be combined to save fuel.

FIG. 5 shows several different array patterns of Hall effect electric propulsion systems of the present invention for attaching to a side of a spacecraft. Referring now to FIG. 5, a plurality of individual Hall effect electric propulsion systems may be attached to a side of a spacecraft, forming an array of thrusters. Various sides of the spacecraft could have such arrays mounted on them. Since the Hall effect electric propulsion system of the present invention is suited for miniaturization, the array could contain hundreds of individual systems all linked together and controlled by a master control system (not shown in FIG. 5).

For example, array 502 is made up of several Hall effect electric propulsion systems arranged in a square pattern. Array 504 has several Hall effect electric propulsion systems arranged in a diamond pattern. Array 506 is in a cross pattern, and array 508 is in a circular pattern. One skilled in the art will recognize that various other array patterns could be used depending upon the design criteria and the center of gravity of the spacecraft involved, and that each pattern could contain more or less than the number of systems that are shown for each array pattern. Hall effect electric propulsion systems 100, 300, or 400 could be utilized in such array patterns.

By activating different combinations of the individual Hall effect electric propulsion systems, different thrust vectors can be achieved. The output of each Hall effect electric propulsion system may be throttled by controlling the propellant flow and ionization energy to the ionizer in each system. In the event of an individual failure of one Hall effect electric propulsion system, the entire array would not be lost, since the remaining operational systems may be selectively activated to compensate for the malfunctioning system. This gives both a steering mechanism without gimbals, a significant weight savings, and engine redundancy. This also allows for optimized trajectories where turning and thrusting maneuvers may be combined to save fuel.

The foregoing description of the present invention has been presented for purposes of illustration and description. Furthermore, the description is not intended to limit the invention to the form disclosed herein. Consequently, variations and modifications commensurate with above teachings, and the skill or knowledge of the relevant art, are within the scope of the present invention. The embodiments described hereinabove are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. A propulsion apparatus comprising a magnet having a back end portion and a front end portion and an acceleration chamber defined therebetween, an aperture formed in said front end portion of said magnet, wherein said aperture opens into said acceleration chamber, and a first pole opposite a second pole at said aperture, at least one ionizer located within said acceleration chamber for positively ionizing a flow of propellant molecules introducible into said acceleration chamber before said molecules reach the aperture, and electron generator means for directing an electron beam toward a magnetic field generated by said magnet, between said first and second poles at said aperture, for trapping a first plurality of electrons of said electron beam in a flux of said magnetic field to form an electron cloud, for accelerating said positively ionized flow of propellant molecules through said electron cloud, for neutralizing a first portion of said positively ionized flow of propellant molecules by combining with a first portion of said first plurality of electrons in said electron clouds, thereby producing a plurality of neutral propellant molecules each having momentum to produce thrust.

2. A propulsion apparatus according to claim 1 wherein a face of said first pole and a face of said second pole of said magnet are oriented non-parallel relative to each other causing said flux of said magnetic field to be asymmetric.

3. A propulsion apparatus according to claim 1 wherein said ionizer is one of an electric arc source and a heating element.

4. A propulsion apparatus according to claim 1, wherein said magnet is one of a permanent magnet and an electromagnet.

5. A propulsion apparatus according to claim 1 wherein an interior surface area of said acceleration chamber is coated with TEFLON.

6. A propulsion apparatus according to claim 1 further comprising:

a positive anode located within said acceleration chamber and in proximity to said back end portion of said magnet for repelling said positively ionized flow of propellant molecules towards a phantom cathode formed by said electron cloud.

7. A propulsion apparatus according to claim 1 further comprising:

a first sacrificial anode housing at ground potential on a first outer portion of said magnet for attracting a second portion of said positively ionized flow of propellant molecules not neutralized after passing through said electron cloud.

8. A propulsion apparatus according to claim 1 wherein said electron generator is an electron gun.

9. A propulsion apparatus according to claim 1 further comprising:

a plurality of insulated non-ferromagnetic dividers within said magnet, wherein said acceleration chamber includes a plurality of acceleration chamber segments within said magnet; and a plurality of supply tubes, each for correspondingly introducing a portion of said flow of propellant molecules into said plurality of acceleration chamber segments, wherein a first plurality of first thrust vectors and a second plurality of second thrust vectors are generated through positively ionizing each said portion of said flow of propellant molecules introduced into said plurality of acceleration chamber segments with said ionizer, wherein said first plurality of first thrust vectors are different from said second plurality of second thrust vectors.

10. A propulsion apparatus according to claim 9 wherein said plurality of acceleration chamber segments are arranged annularly within said magnet.

11. A propulsion apparatus according to claim 9 wherein said plurality of acceleration chamber segments are arranged linearly within said magnet.

12. A propulsion apparatus according to claim 1 wherein the propulsion apparatus is mounted to a space vehicle to provide said thrust for said space vehicle.

13. A propulsion apparatus according to claim 1 wherein a plurality of the propulsion apparatus are mounted to a space vehicle to form an array, wherein a first plurality of first thrust vectors and a second plurality of second thrust vectors are generated through introducing said flow of propellant molecules into said plurality of the propulsion apparatus, wherein said first plurality of first thrust vectors are different from said second plurality of second thrust vectors.

14. A hall effect thruster comprising a magnet having a back end portion and a front end portion and an acceleration chamber defined therebetween, an aperture formed in said front end portion of said magnet wherein said aperture opens into said acceleration chamber, and a first pole opposite a second pole at said aperture, wherein a face of said first pole and a fact of said second pole of said magnet are oriented non-parallel relative to each other causing a flux of a magnetic field induced between said first and second poles to be asymmetric, electron generator means, located exterior to said acceleration chamber, for generating an electron beam toward said asymmetric magnetic field and for trapping a first plurality of electrons of said electron beam in said flux of said magnetic field to form an electron cloud, and at least one ionizer located within said acceleration chamber for positively ionizing a flow of propellant molecules introducible into said acceleration chamber before said molecules reach the aperture.

15. A Hall effect thruster according to claim 14, wherein said flow of propellent molecules are electromagnetically accelerated through said electron cloud, wherein a first portion of said positively ionized flow of propellant molecules becomes neutralized by combining with a first portion of said first plurality of electrons in said electron cloud producing a plurality of neutral propellant molecules each having momentum to produce thrust.

16. A Hall effect thruster according to claim 14 wherein said ionizer is one of an electric arc source and a heating element.

17. A Hall effect thruster according to claim 14 wherein an interior surface area of said acceleration chamber is coated with TEFLON.

18. A Hall effect thruster according to claim 14 further comprising:

a first sacrificial anode housing at ground potential on a first outer portion of said electromagnet for attracting a second portion of said positively ionized flow of propellant molecules not neutralized after passing through said electron cloud.

19. A Hall effect thruster according to claim 14 wherein said flow of propellant molecules is a flow of noble gas molecules.

20. A Hall effect thruster according to claim 14 wherein a plurality of the Hall effect thrusters are mounted to a space vehicle to form an array, wherein a first plurality of first thrust vectors and a second plurality of second thrust vectors are generated through introducing said flow of propellant molecules into said plurality of the Hall effect thrusters, wherein said first plurality of first thrust vectors are different from said second plurality of second thrust vectors.

21. A hall effect thruster comprising:

an electromagnet having a first pole opposite a second pole, wherein said first and second poles are located at an aperture formed in a first and portion of said electromagnet, and further wherein a face of said first pole and a face of said second pole are oriented non-parallel relative to each other, causing a flux of a magnetic field induced between said first and second poles to be asymmetric, at least one ionizer located within an acceleration chamber formed between a second end portion and said first end portion of said electromagnet, wherein a flow of propellant molecules introducible into said acceleration chamber are ionized by said ionizer before said molecules reach the aperture, and electron generator means for generating an electron beam toward said asymmetric magnetic field to form an electron cloud, for electromagnetically accelerating said flow of propellant molecules through said electron cloud, neutralized, and for expelling them to produce thrust.

* * * * *